United States Patent [19]

Usui et al.

[11] Patent Number: 4,506,506

[45] Date of Patent: Mar. 26, 1985

[54] EXHAUST EMISSION CONTROL DEVICE FOR DIESEL ENGINE

[75] Inventors: Toshifumi Usui, Katsuta; Syozo Yanagisawa, Toukai, both of Japan

[73] Assignee: Hitachi, Ltd., Tokyo, Japan

[21] Appl. No.: 517,817

[22] Filed: Jul. 27, 1983

[30] Foreign Application Priority Data

Aug. 2, 1982 [JP] Japan ..... 57-133690

[51] Int. Cl.[3] ..... F01N 3/02

[52] U.S. Cl. ..... 60/303; 60/311; 55/283; 55/466; 55/DIG. 10; 55/DIG. 30

[58] Field of Search ..... 60/300, 303, 311, 284; 55/283, 466, DIG. 10, DIG. 30

[56] References Cited

U.S. PATENT DOCUMENTS 3,732,696 5/1973 Masaki ..... 60/286

3,910,042 10/1975 Yuge ..... 60/300

4,345,431 8/1982 Suzuki ..... 60/297

*Primary Examiner*—Douglas Hart

*Attorney, Agent, or Firm*—Antonelli, Terry & Wands

[57] ABSTRACT

An exhaust emission control device for Diesel engines comprising a trap disposed in an exhaust pipe connected to an exhaust manifold and a trap-heating burner disposed outside the exhaust pipe, whereby a combustion gas from the burner is led to the outer peripheral portion of the trap to heat the same.

According to the exhaust emission control device for Diesel engines of the present invention, the stable oxidation of particulates collected on the trap in the exhaust pipe is achieved independently of the flow rate of the exhaust gas, the exhaust pressure and the amount of $O_2$ in the exhaust gas.

2 Claims, 1 Drawing Figure

EXHAUST EMISSION CONTROL DEVICE FOR DIESEL ENGINE

BACKGROUND OF THE INVENTION

The present invention relates to an exhaust emission control device for Diesel engines and more particularly to an exhaust emission control device for Diesel engines in which particulates in the exhaust gas from a Diesel engine are collected on a trap and oxidized using a burner to regenerate the trap.

Among systems for reducing particulates in the exhaust gas employed by exhaust emission control devices for Diesel engines, including the mechanical particulate trapping system and the electrostatic precipitation system, such a system is general that particulates are collected on a trap and oxidized. One of methods of oxidizing particulates employs a burner, and such a device has hitherto been proposed that a trap is fitted in an exhaust pipe connected to the exhaust manifold of a Diesel engine, and a burner is provided on the upstream side of the trap in the exhaust pipe to oxidize particulates collected on the trap by means of flames jetted out into the exhaust pipe. The device of this type has been disclosed in W. R. Wade et al, "Diesel Particulate Trap Regeneration Techniques", SAE Paper No. 810118, February, 1981.

The oxidation rate constant k of particulates is expressed by the Arrhenius' equation: $k=A\ \exp(-\Delta E/RT)$. It will be clear from the equation that the oxidation rate depends upon only temperature. Accordingly, in order to oxidize particulates with high efficiency, it is necessary to rapidly raise the atmospheric temperature of the collected particulates. In the conventional device having the above-described construction, however, since the flames from the burner are applied only from the trap inlet front surface, the heat-receiving area of the trap is small, so that it is impossible to obtain a uniform temperature rise throughout the trap. Moreover, since the flames from the burner are directly jetted out into the exhaust gas, the combustion condition of the burner is affected by the flow rate of the exhaust gas, the exhaust pressure, the amount of $O_2$ in the exhaust gas and so forth, which largely vary according to the engine operating conditions. Therefore, it is extremely difficult to effect control so that the burner will perform a complete combustion at all times.

SUMMARY OF THE INVENTION

Accordingly, it is an object of the invention to provide an exhaust emission control device for Diesel engines capable of efficiently effecting the regeneration of the trap.

It is another object of the invention to provide an exhaust emission control device for Diesel engines capable of stably effecting the oxidation of particulates collected on the trap in the exhaust pipe independently of the flow rate of the exhaust gas, the exhaust pressure and the amount of $O_2$ in the exhaust gas.

To these ends, according to the invention, there is provided an exhaust emission control device for Diesel engines comprising: a trap disposed in an exhaust pipe connected to an exhaust manifold; and a trap-heating burner disposed outside the exhaust pipe, whereby a combustion gas from the burner is led to the outer peripheral portion of the trap to heat the same.

BRIEF DESCRIPTION OF THE DRAWING

The FIGURE is a sectional view of an embodiment of an exhaust emission control device in accordance with the invention.

DESCRIPTION OF THE PREFERRED EMBODIMENT

Figure 1:
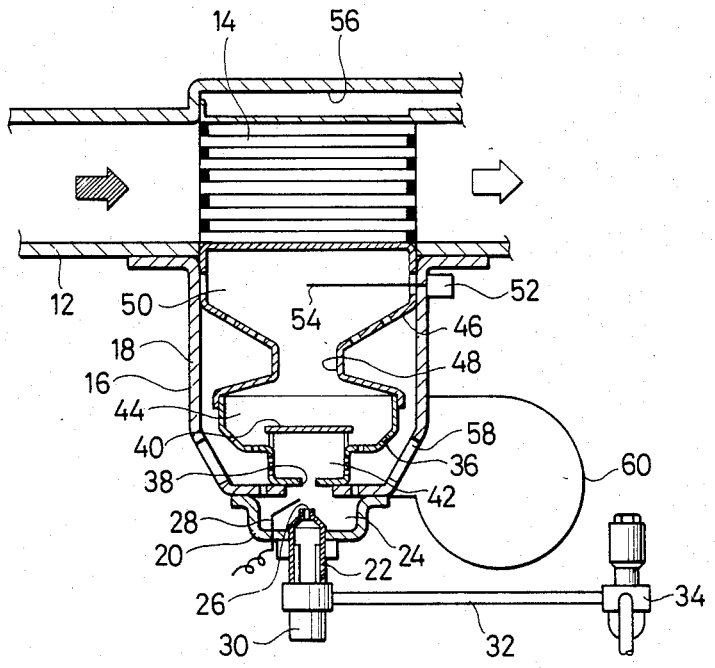

Referring to the FIGURE, which is a sectional view of an embodiment of an exhaust emission control device in accordance with the invention, an exhaust pipe 12 is provided with a trap 14 for collecting particulates.

The trap 14 fitted in the exhaust pipe 12 is generally a ceramic honeycomb trap. When the exhaust gas passes through the honeycomb trap 14, particulates are trapped at porous walls thereof. A burner 16 is secured to the side of the exhaust pipe 12 having the trap 14 fitted therein. The burner 16 has a nozzle 22 secured through a nozzle holder 20 to the end portion of a burner casing 18 secured to the exhaust pipe 12. A nozzle port 26 of the nozzle 22 is inserted into an ignition chamber 24 defined by the nozzle holder 20, and an ignition electrode 28 is provided in front of the nozzle port 26. In addition, the nozzle 22 is provided with a solenoid valve 30 so that the fuel pumped from a fuel pump 34 through a pipe 32 can be cut off when the burner 16 is turned off.

A first partition member 36 is fixed in the burner casing 18 in front of the nozzle port 26, and a throttle portion 38 is formed on the side of the substantially speaker-shaped first partition member 36 closer to the nozzle (on the upstream side). The first partition member 36 has a diffusion plate 40 provided in the central portion thereof, so that the space inside the first partition member 36 is divided by the diffusion plate 40 into a gasifying chamber 42 and a mixing chamber 44 on the upstream and downstream sides thereof, respectively.

The downstream-side end of the first partition member 36 is connected to the upstream-side end of a second partition member 46, and the downstream-side of a throttle portion 48 formed on the second partition member 46 is defined as a combustion chamber 50, into which a detecting portion 54 of a flame detector 52 secured to the burner casing 18 is inserted. In addition, a gas flow passage 56 is formed extending from the combustion chamber 50 so as to surround the peripheray of the trap 14.

It is to be noted that a casing air vent 58 is formed in a portion of the burner casing 18 corresponding to the side of the first partition member 36 so that the air from a blower 60 can be introduced into the burner 16.

The operation of the embodiment arranged such as described above is as follows.

The nozzle 22 measures the fuel pressurized by the fuel pump 34 and jets out the fuel being atomized from the nozzle port 26 into the ignition chamber 24. The atomized fuel in the ignition chamber 24 is ignited by means of a spark generated by the ignition electrode 28. After entering the gasifying chamber 42, the fuel is gasified by the red-hot diffusion plate 40 and sent into the mixing chamber 44. The fuel entering the mixing chamber 44 is accelerated in gasification by the second partition member as well as mixed with the air supplied from the blower 60. Thereafter, the fuel which is gasified and mixed with the air enters the combustion chamber 50 to burn being supplied with air necessary for combustion. The combustion gas of the fuel thus completely burned in the burner 16 is discharged to the outside through the gas flow passage 56 provided around the trap 14.

Owing to the fact that the combustion of fuel by the burner 16 takes place outside the exhaust pipe 12 as described above, the combustion of fuel by the burner 16 can be conducted without being adversely affected by the pressure and exhaust pulsation in the exhaust pipe, chemical components in the exhaust gas and so forth. Moreover, by supplying the combustion gas from the burner 16 to the periphery of the trap 14, it is possible to make the trap 14 high in temperature under a stable state. In addition, the burner can be installed without requiring any large modification of the exhaust manifold and the like.

Although the above-described embodiment is arranged such that the combustion gas from the burner is discharged to the outside, the combustion gas may be introduced into the exhaust pipe 12.

To efficiently regenerate the trap of the exhaust emission control device in accordance with the invention, the combustion of fuel by the burner is controlled in consideration of that the increase in ventilation resistance of the trap due to the increase in amount of the collected particulates, i.e., the pressure loss in the trap rapidly enlarges as the engine operating time becomes longer, and that as the engine speed is higher, or the engine load is larger, the temperature of the exhaust gas itself becomes higher and the trap temperature rises, so that the particulates are oxidized without being heated by the burner particularly.

More specifically, the rate of change of the trap pressure loss with the changes of the engine speed and the engine load is experimentally obtained and previously fed into a controller. The pressure loss is calculated from an actual engine speed and engine load according to the change rate, and when the pressure loss exceeds any desired set level, the burner 16 is actuated. Since the trap temperature and the trap regeneration time are inversely proportional to each other regardless of the size of the trap, it is only necessary to arrange such that the trap temperature during the operation of the burner is detected, and the operating time of the burner can be automatically set by the controller according to the detected trap temperature.

By thus effecting the control of the combustion of fuel by the burner with an appropriate timing according to the engine operating conditions, it is possible to eliminate any wasteful combustion of fuel by the burner, and the exhaust emission control device can be improved in economy.

What is claimed is:

1. An exhaust emission control device for Diesel engines comprising:

(a) an exhaust pipe for introducing the exhaust gas from a Diesel engine to the outside;

(b) a trap disposed in said exhaust pipe for collecting particulates in the exhaust gas;

(c) a burner disposed outside said exhaust pipe; and (d) a combustion gas passage for introducing the combustion gas from said burner to the outer periphery of said trap to superheat said trap while isolating the combustion gas from the exhaust gas in said exhaust pipe.

2. An exhaust emission control device for Diesel engines according to claim 1, wherein said trap is a ceramic honeycomb trap.

* * * * *